United States Patent [19]

Abdalla

[11] Patent Number: 4,532,454

[45] Date of Patent: Jul. 30, 1985

[54] ELECTROLUMINESCENT DISPLAY HAVING DARK FIELD SEMICONDUCTING LAYER

[75] Inventor: Mohamed I. Abdalla, Los Angeles, Calif.

[73] Assignee: GTE Laboratories Incorporated, Waltham, Mass.

[21] Appl. No.: 532,867

[22] Filed: Sep. 16, 1983

[51] Int. Cl.[3] ..... N01J 1/62

[52] U.S. Cl. ..... 313/506; 313/499; 313/500

[58] Field of Search ..... 313/498, 499, 500, 506

[56] References Cited

U.S. PATENT DOCUMENTS 3,650,824 3/1972 Szepesi et al. ..... 313/498 X 3,920,491 11/1975 Yonezu ..... 313/499 X 4,188,565 12/1980 Mizukami et al. ..... 313/509

4,455,506 6/1984 Ayyagari et al. ..... 313/506

*Primary Examiner*—Robert Lindsay

*Attorney, Agent, or Firm*—J. Stephen Yeo

[57] ABSTRACT

An electroluminescent display is constructed as a laminate with a transparent front electrode and a metallic rear electrode sandwiching a layer of electroluminescent phosphor. A layer of light absorbing semiconducting material is interposed between the phosphor layer and the rear electrode. The semiconducting layer functions as a dark field increasing the contrast of the display. Furthermore, the semiconducting layer may be used in the fabrication of driver circuits integral to the display.

3 Claims, 2 Drawing Figures

ELECTROLUMINESCENT DISPLAY HAVING DARK FIELD SEMICONDUCTING LAYER

BACKGROUND OF THE INVENTION

This invention pertains to electroluminescent displays and, more particularly, is concerned with electroluminescent devices having contrast enhancing dark fields.

One form of electroluminescent (EL) display includes a transparent EL active laminate interposed between a transparent front electrode and a metallic rear electrode. The electrodes are segmented to correspond to the elements of the displays, which may be alphanumeric or a dot matrix.

The EL active laminate may include an EL phosphor layer sandwiched by dielectric layers. U.S. Pat. No. 4,188,565 suggests use of the non-conducting silicon compounds SiO, $SiO_2$, $Si_3N_4$ as dielectric materials.

When the EL laminate is excited by voltage applied between the front and rear electrodes it emits light. Some of this light reflects off the metallic rear electrode. This reduces contrast and the display's legibility. For this reason, it has been suggested to include a so-called dark field layer of light absorbing material between the active laminate and the rear electrode. Cermet and other materials have been suggested, but it has not been realized that a semiconducting material such as silicon can be used as a dark field material.

Provision must be made to prevent haloing or crosstalk between elements of a display. This occurs when some of the current applied to one electrode activates a non-corresponding element.

Furthermore, it is necessary to drive each element of the display separately. For this reason, an individual switching transistor may be associated with each element. The prior art calls for a physically separate driver circuit as, until the present invention, it was not realized that a driver circuit could be made physcially integral with the display.

DESCRIPTION OF THE INVENTION

Figure 1:
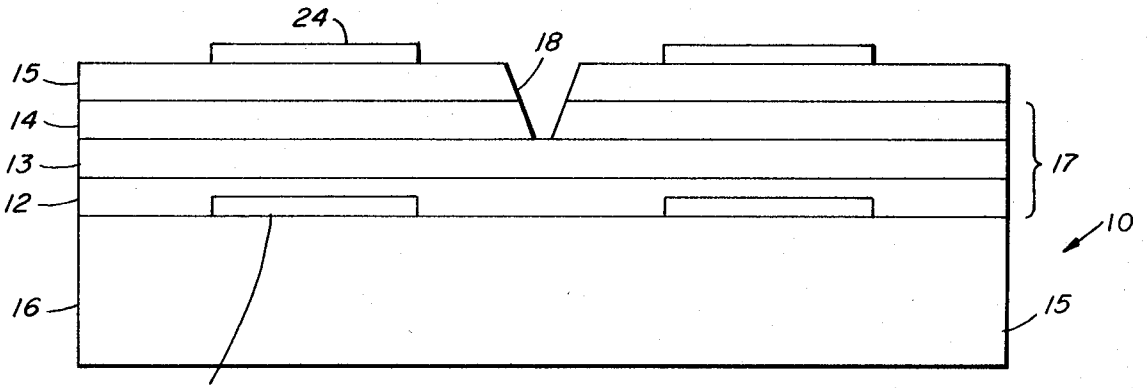
FIG. 1 shows in cross section a portion of an EL display which has a semiconducting dark field according to the invention.

Referring to FIG. 1, there is seen a section 10 of an electroluminescent (EL) display that embodies one aspect of the invention. The display is comprised of a series of thin films 11–15 deposited sequentially upon a glass-like transparent substrate 16.

Substrate 16 is the front side of the display through which the display is viewed. The substrate 16 supports and protects the thin films, the first being a transparent electrode 11 of a tin oxide or other transparent conductive material vacuum deposited upon the substrate. The transparent electrode 11 may be segmented as shown, or continuous across the substrate.

Next, an EL active laminate 17 is laid over the transparent electrode and substrate. The EL active laminate 17 is typically comprised of three superposed layers; an EL phosphor layer 13 sandwiched between two dielectric layers 12, 14. Each layer is deposited by known sputtering techniques. These layers are transparent so that any subsequent structure can be seen from the front of the display.

As feature of the invention, a semiconducting layer is sputtered on the active laminate as a polycrystalline layer 15. The semiconducting layer 15 functions as a light absorbing dark field which, as will be understood, increases the display's contrast. Silicon (Si) is the preferred semiconducting material, but GaAs, Ge, and InP are also suitable.

Metallic rear electrodes are then deposited on the semiconducting layer. The rear electrodes are segmented to correspond to segments or dots of the display. When sufficient AC voltage is applied across corresponding front and rear electrodes, the intermediate active laminate will luminate.

Typically, rear electrode 24 is aluminum which in the absence of a dark field would be visible from the front of the display. The rear electrodes would normally reflect both ambient and generated light reducing contrast. The semiconducting layer 15, however, is generally opaque in the visible and absorbs scattered light, thereby increasing contract between luminating and non-luminating elements of the display by optically isolating the rear electrode 24 from the EL active laminate 17.

The semiconducting layer 15 seals and protects the active luminate. Furthermore, it can be tailored to reduce crosstalk or haloing effects. The resistivity of the semiconducting layer is controllable by adding p- or n-type dopants. In this way a compromise between resistive losses and crosstalk can be obtained. Alternatively, the semiconducting layer 15 can be segmented by etching grooves 18, so as to prevent crosstalk between elements.

For an effective display each EL segment is energized independently by a driver circuit. As a further feature of the invention, the semiconducting layer 15 may have to provide the additional function of being the substrate of such driver circuits integrated on the back of the EL display.

Figure 2:
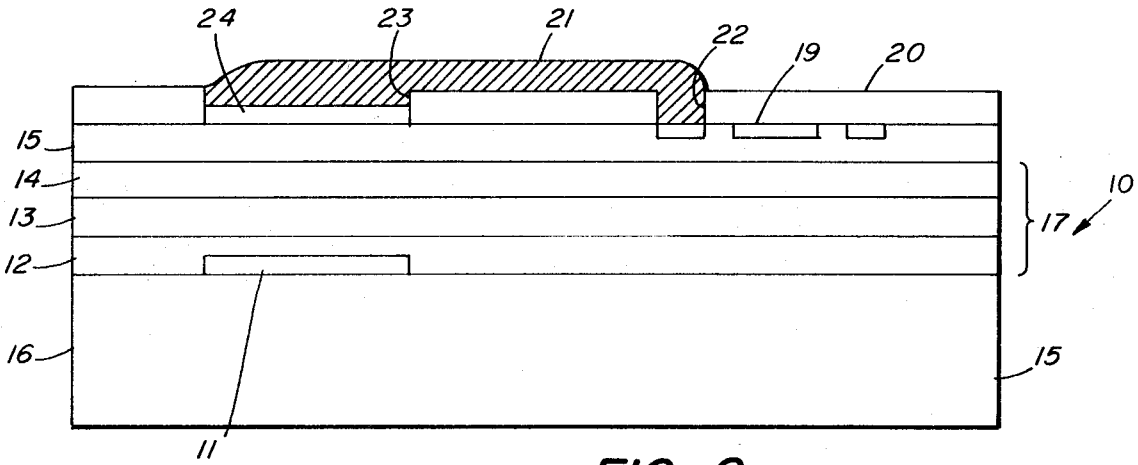
FIG. 2 is a cross-sectional representation of an EL display including an integral driver circuit.

Using photolithographic techniques, n-type and p-type dopants are implanted in the surface of the semiconductor to fabricate bipolar or field effect transistors. In FIG. 2 there is seen an n-p-n bipolar transistor 19 adjacent to a rear electrode 24. An insulating layer 20 of silicon oxide is laid upon the semiconducting layer 15. Aluminum contacts 21 connecting the output of each transistor and its corresponding rear electrode segment may be deposited simultaneously through windows 22, 23 etched in layer 20, thereby completing the integrated drive circuit.

What is claimed is :

1. An electroluminescent display comprised of:

a transparent substrate;

at least one transparent electrode supported by said substrate;

an electroluminescent laminate deposited over said transparent electrode;

a polycrystalline semiconducting layer of Si, GaAs, Ge, or InP deposited upon said electroluminescent laminate; and at least one rear electrode deposited upon said semiconducting layer;

said rear electrode optically isolated from said electroluminescent laminate by said semiconducting layer.

2. The device of claim 1 which includes at least two of said rear electrodes separated by a groove etched through one or more of said layers.

3. The device of claim 1 wherein the resistivity of the semiconducting layer is selected to reduce haloing and crosstalk by the addition of dopants.

* * * * *